US007068953B2

(12) United States Patent
Tombs et al.

(10) Patent No.: US 7,068,953 B2
(45) Date of Patent: Jun. 27, 2006

(54) METHOD AND APPARATUS FOR VALIDATING FUSER MEMBER BEHAVIOR

(75) Inventors: Thomas N. Tombs, Rochester, NY (US); Joseph A. Pavlisko, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 95 days.

(21) Appl. No.: 10/836,794

(22) Filed: Apr. 30, 2004

(65) Prior Publication Data

US 2005/0244168 A1 Nov. 3, 2005

(51) Int. Cl.
*G03G 15/00* (2006.01)
*G03G 15/20* (2006.01)

(52) U.S. Cl. ..... 399/12; 399/122

(58) Field of Classification Search ..... None
See application file for complete search history.

(56) References Cited

U.S. PATENT DOCUMENTS 4,415,800 A 11/1983 Dodge et al. ..... 219/497
6,016,415 A 1/2000 Herrick et al. ..... 399/162

FOREIGN PATENT DOCUMENTS

JP 10260612 A * 9/1998

* cited by examiner

*Primary Examiner*—Quana Grainger
(74) *Attorney, Agent, or Firm*—Donna Suchy; Lawrence P. Kessler

(57) ABSTRACT

Method and apparatus for validating that a fuser member presumptively belongs to a class of fuser member for imparting a certain surface finish to an electrophotographic output print, and/or validating that the fuser member has a heating behavior within specification. Utilizing a temperature-sensing device for measuring temperature of the fuser member during heating thereof, a validation number is computed for comparison with a range of validation numbers associated with the class. If the validation number is included in the range, membership in the class is confirmed and/or the fuser member is shown to be within specification. Additionally, an auxiliary measuring device can be associated with the fuser roller to generate signals for computing, from measurements of a temperature-dependent property of the roller, a validation number relating to the temperature-dependent property.

17 Claims, 10 Drawing Sheets

METHOD AND APPARATUS FOR VALIDATING FUSER MEMBER BEHAVIOR

FIELD OF THE INVENTION

The invention relates to fusing in an electrostatographic machine, and in particular to measuring a heating behavior of a fuser member so as to validate that the fuser member belongs to a certain class of fuser member and/or to validate that the heating behavior is in accordance with specification.

BACKGROUND OF THE INVENTION

In electrostatographic imaging and recording processes, such as electrophotographic printing, an electrostatic latent image is formed on a primary image-forming member such as a photoconductive surface and is developed with a thermoplastic toner powder to form a toner image. The toner image is thereafter transferred to a receiver member, e.g., a sheet of paper or plastic, and the toner image is subsequently fused to the receiver member in a fusing station using heat and/or pressure. The fuser member can be a roller, belt, or any surface having a suitable shape for fixing thermoplastic toner powder to the receiver member. Fusing is commonly accomplished by passing the toned receiver member between a pair of engaged rollers that produce an area of pressure contact known as a fusing nip. In order to form the nip, at least one of the rollers typically has a compliant or conformable layer on its surface. Heat is transferred from at least one of the rollers to the toner in the fusing nip, causing the toner to partially melt and attach to the receiver member. Where the fuser member is a heated roller, it is generally desirable for it to have a smooth surface in contact with the toner. Where the fuser member is in the form of a belt, e.g., a flexible endless belt that passes around a heated roller, it typically has a smooth, hardened outer surface.

In most fusing stations utilizing a fuser roller and an engaged pressure roller, it is common for one of the two rollers to be rotated by any suitable mechanism, the other roller being counter-rotated by frictional forces in the nip.

In a simplex roller fuser, toner is attached or fixed to one side of a receiver member at a time. In this type of fuser, the roller that contacts the unfused toner, herein called the "fuser roller", is usually actively heated. The roller that contacts the other side of the receiver member, herein called the "pressure roller", is usually not directly heated. Either or both rollers can have a compliant layer on or near the surface for forming a fusing nip of useful width.

In a duplex fusing station, which is less common, two toner images are simultaneously attached, one to each side of a receiver member passing through a fusing nip. In such a duplex fusing station there is no real distinction between fuser roller and pressure roller, both rollers performing similar functions, i.e., providing heat and pressure.

Two basic types of simplex roller fusers have evolved. One type uses a compliant pressure roller to form the fusing nip against a hard fuser roller. The other type uses a compliant fuser roller to form the nip against a hard pressure roller. (A roller designated herein as "compliant" includes a conformable layer or cushion layer typically having a thickness greater than about 2 mm and in some cases exceeding 25 mm; a roller designated as "hard" includes a rigid cylinder which typically has thereon a relatively thin polymeric or resilient elastomeric coating, typically less than about 1.25 mm thick).

A conventional fuser roller includes a cylindrical core member, often metallic such as aluminum, coated with one or more synthetic layers which typically include polymeric materials made from elastomers.

The most common type of fuser roller includes an internal source of heat. Such an internally-heated fuser roller normally has a hollow core, inside of which is located a heating source, usually a lamp. The cushion layer surrounding the core of a compliant fuser roller is an elastomeric layer through which heat is conducted from the core to the surface, and the elastomeric layer typically contains fillers for enhanced thermal conductivity.

An externally-heated fuser roller is also known, typically heated by surface contact between the fuser roller and one or more heating rollers pressed against the fuser roller.

A typical belt fuser can embody a heated roller around which is entrained a closed-loop belt under tension, the heated roller forming a fusing nip with a pressure roller such that the belt is captured in the nip and thereby indirectly heated. During fusing, the unfused toner on a receiver member is in contact with the indirectly heated belt.

In certain fusing stations a belt can be provided entrained around a pressure roller, which belt is captured in a fusing nip between the pressure roller and a heated fuser roller and helps to move a receiver member through the fusing nip.

To create high quality multicolor toner images, small toner particles are used having diameters less than about 10 micrometers, and the receiver members, typically papers, are smooth and can be coated papers. A typical method of making a multicolor toner image involves trichromatic color synthesis by subtractive color formation. In such synthesis, successive imagewise electrostatic images, each representing a different color, are developed with a respective toner of a different color. Typically, the colors correspond to each of the three subtractive primary colors (cyan, magenta, and yellow) and, optionally, black. As described for example in the Herrick et al. patent (U.S. Pat. No. 6,016,415), an electrophotographic printer apparatus can include a series of tandem modules wherein color separation images are formed and transferred in register to a receiver member being moved through the apparatus while supported on a transport web. An unfused toner image formed thereby on the receiver member is subsequently moved to a fusing station for fusing therein.

To rival the photographic quality of glossy prints produced using silver halide technology, it is desirable that multicolor toner images have suitable glossiness. The amount of gloss depends on the material characteristics of the toner, the smoothness of the fuser member, the pressure in the fusing nip, and on the temperature of the fusing station. In particular, a uniform glossing level depends on the ability of a heated fuser member to provide a suitably rapid response time, e.g., for overcoming fluctuations in the demand for heat as receiver members are moved through the fusing station, or during cycle-up from a cold start to operating temperature.

The degree of gloss or gloss level of a toner image can be quantitatively measured in a standard way using a specular glossmeter, for example by the method described in ASTM-D523-67. Typically, a single reflectivity measurement is made which measures the amount of light from a standard source which is specularly reflected in a defined path. A suitable device for this purpose is a Glossgard II 60° glossmeter (available commercially from Pacific Scientific Inc., Silver Springs, Md.) which produces a reading, on a standardized scale, of a specularly reflected beam of light having angles of incidence and reflection of 60° to the normal. The glossmeter can measure gloss levels representing a dull matte to a very shiny finish. The usual range of measured gloss numbers on the meter is between 0 and 100, the instrument being normally calibrated or adjusted so that the upper limit corresponds to a surface that has substantially less than the complete specular reflection of a true mirror. Thus extremely smooth glossy surfaces can have gloss levels in excess of 100. Reflectivity readings are indicated as $G_{60}$ gloss numbers (gloss levels). The larger the $G_{60}$ number, the glossier the toner image.

The area of contact between a conformable fuser roller and a toner-bearing surface of a receiver sheet as it passes through the fusing nip is determined not only by the pressure exerted in the nip but also by the characteristics of the cushion layer (preferably located on the fuser roller). The extent of the contact area helps establish the length of time that any given portion of the toner image will be in contact with and heated by the fuser roller, and is an important variable dictating the amount of heat generated in the fusing station and carried away by receiver members.

To monitor the temperature of a fuser member, at least one temperature sensor is typically mounted in association with the fuser member. The sensor sends electronic information relating to the temperature of the member to a microprocessor, for example, or to a logic and control unit (LCU). Thus for example a thermistor can be used mounted in direct contact with a thermally conductive core member of a fuser roller. Any suitable temperature-sensing device can be employed in order to create a precalibrated electronic signal for continuous monitoring of the temperature of the fuser member.

As disclosed in the Dodge et al. patent (U.S. Pat. No. 4,415,800), the temperature of a fuser roller in a fusing station can be controlled via a microcomputer utilizing signals sent by a temperature sensor for sensing the temperature of the fuser roller at a predetermined time. In particular, temperature-versus-time profiles can be measured during heating of a roller to operating temperature, e.g., from a start-up cold temperature or from some warm (or hot) initial temperature remaining after a temporary shutdown of the fusing station. Error messages can be displayed and/or the fusing station automatically shut down if there is inappropriate behavior of the roller, such as may be caused by a malfunction resulting in overheating or underheating relative to the (predetermined) operating temperature.

For use in a fusing station employing a heated fuser roller, it is known to have on hand several variations of fuser rollers having different surface finishes, which rollers can be interchangeably installed for purpose of producing different gloss levels in fused toner images. Thus one type of fuser roller can be used for jobs requiring a matte finish (little or no gloss), another type of fuser roller used for medium gloss, and a third type used for making high gloss toner images. Typically, matte images are text images having for example all-black text, whilst high gloss images are for pictorial imaging, particularly for photographic quality imaging on smooth papers. If a fuser roller needs to be replaced or exchanged, e.g., when a new job stream requires a certain type of fuser roller which is different from that already mounted in the fusing station, the mounted fuser roller is removed, e.g., manually, and replaced by another fuser roller so as to provide a different surface finish. The source of heat for fusing is then powered up so as to raise the temperature of the newly installed fuser roller to a suitable (predetermined) operating temperature, i.e., for the type of output finish required for fused toner images of the new job stream.

There is a need for a low cost way to validate that a newly installed fuser roller is of a presumptive type, with the further objects of minimizing human error or loss of time as could occur if an operator manually installs the wrong type of fuser roller, or if an operator fails to properly select the respective operating set points needed for a given type of fuser roller. The present invention provides a reliable, inexpensive, validation method. Moreover, a newly installed fuser roller of a given type may exhibit a particular heating behavior that is not within specification, e.g., because other devices are adjacent to or contact the fuser roller in the fusing station. Thus there is a need to measure this heating behavior, and the invention provides a simple way to validate that a newly installed fuser roller has a heating behavior commensurate with specification.

SUMMARY OF THE INVENTION

The subject invention provides method and apparatus to monitor a heating behavior of a fuser member. The invention can be used to confirm that the fuser member, exchangeably installed in an electrophotographic fusing station, is included in a particular class of fuser member for imparting to a fused toner image a surface finish relating to that class. The surface finish is produced as a result of fusing an unfused toner image to a receiver member moved through the fusing station. According to the invention, at least one temperature of the installed fuser member and/or at least one value of a property inherent to the installed fuser member is determined during a time when heating power is being supplied to the fuser member so as to cause increasing temperature thereof, preferably during start-up. In consequence, the installed fuser member can be validated as belonging to a certain class of fuser member for imparting to a fused toner image a designated quality of a preselected surface finish. Alternatively, the invention can be used to verify that the heating behavior of the fuser member is within specification, i.e., within prespecified limits for that class.

In certain preferred embodiments in which the fuser member is a fuser roller, the invention utilizes a temperature-sensing device typically included in the fusing station for purpose of monitoring the temperature of the roller, e.g., by signals sent from the temperature-sensing device to a computer. An auxiliary measuring device associated with the fuser roller can be used in certain embodiments, which auxiliary measuring device is for measuring a certain temperature-dependent property of the fuser roller, such as for example an electrical conductivity. Specifically, the invention provides a method for utilizing certain signals from the temperature-sensing device and/or the auxiliary measuring device so as to identify the type of fuser roller mounted in the machine, or alternatively, to verify that the heating behavior of the fuser roller is within specification for that type. The fuser roller can for example belong a class for which the surface finish is a gloss, which gloss can have various qualities, e.g., "low" gloss (for example, matte), "medium" gloss, or "high" gloss. Fuser rollers of different classes are interchangeably mountable in the fusing station.

In a particularly preferred embodiment, a heating rate of a just-installed fuser roller of presumptively known type and/or specification is the heating behavior measured. A preselected constant power input is provided to the roller during initial heating thereof. A measured heating rate is compared to a reference range of heating rates, which reference range is stored in a look-up table in the computer. A "discontinue heating" instruction is given by a computer and an error signal is preferably displayed if the measured heating rate is not included in the reference range, i.e., is not characteristic of the presumptive class of fuser roller. In this embodiment, the ability to use an already-installed temperature-sensing device advantageously obviates the need for any additional auxiliary measuring device, thereby providing a negligible-cost way for verifying the heating behavior specification and/or eliminating operator error. Such operator error can occur for example when a fuser roller of a known surface-finish class is exchanged for one of a different surface-finish class, e.g., for a new job stream requiring a changed level of gloss in output prints.

In other embodiments, in which an auxiliary measuring device is used, the heating behavior includes a temperature-dependent change of the temperature-dependent property, which temperature-dependent change is monitored by the auxiliary measuring device so as to generate a validation number for comparison to a reference range of validation numbers relating to the heating behavior. In certain of these embodiments, the temperature-sensing device is used in conjunction with the auxiliary measuring device, and as a result, two validation numbers can be generated for comparison with the respective reference ranges of validation numbers.

BRIEF DESCRIPTION OF THE DRAWINGS

In the detailed description of the preferred embodiments of the invention presented below, reference is made to the accompanying drawings, in some of which the relative relationships of the various components are illustrated, it being understood that orientation of the apparatus may be modified. For clarity of understanding of the drawings, some elements have been removed, and relative proportions depicted or indicated of the various elements of which disclosed members are composed may not be representative of the actual proportions, and some of the dimensions may be selectively exaggerated.

DETAILED DESCRIPTION OF THE PREFERRED EMBODIMENTS

Figure 1A:
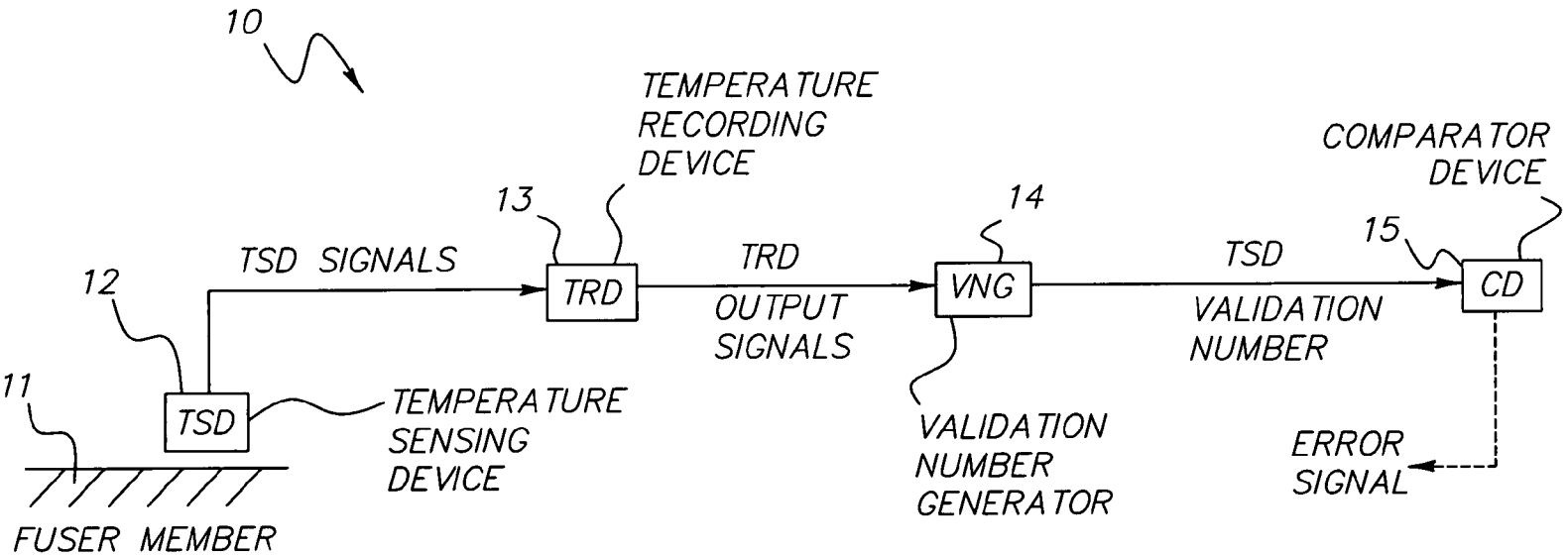
FIG. 1A is a generalized block diagram illustrating how a temperature-sensing device can be used to generate, for purpose of validating a heating behavior of a fuser member, a validation number for comparison with a reference range of validation numbers.

The subject invention provides method and apparatus to monitor a heating behavior of a fuser member for purpose of confirming that the heating behavior is within specification and/or that the fuser member, exchangeably installed in an electrophotographic fusing station, is included in a particular class of fuser member for imparting to a fused toner image a surface finish of designated quality. The surface finish is produced as a result of fusing an unfused toner image to a receiver member moved through the fusing station. According to the invention, a validation number is computed by measuring at least one temperature of the fuser member and/or at least one value of a temperature-dependent property inherent to the fuser member as heating power is supplied and while temperature of the fuser member is increasing, preferably from start-up. The fuser member is validated if the computed validation number is included in a reference range of validation numbers, i.e., if the heating behavior is within specification and/or the fuser member is confirmed as belonging to the particular class.

Preferably, a temperature-versus-time heating profile is measured during heating up of the fuser member from an ambient temperature, which profile typically depends on the heat capacities and thermal conductivities of the various layers of the fuser member. Thus, heating rates during initial heating of the fuser member are governed at least in part by the dimensions and compositions of these layers, which dimensions and compositions are typically tailored to the type of surface finish produced by the fuser member.

A heating behavior of an installed fuser member useful for validation of the fuser member includes, but is not restricted to: a temperature reached at a certain time after initiation of heating, a heating rate, and a change in magnitude of a measured temperature-dependent property of the fuser member during heating. A heating behavior of the fuser member can be considered to be a property inherent to the fuser member.

A temperature-dependent property of a fuser member measurable for validation thereof can for example include, but is not restricted to: (i) a color change of the fuser member caused by increase of temperature during heating; (ii) a surface or volume electrical conductance (resistance) change during heating; (iii) a change of reflectance caused by heating; (iv) a heat flow rate in the fuser member. Any temperature-dependent property that is measurable during heating of the fuser member can, at least in principle, be used to obtain a validation number.

A surface finish of a fused toner image can be a gloss, a texture, or a pattern, but is not restricted thereto. The surface finish produced by a given fuser member determines the class to which the fuser member belongs. Certain surface finishes can have more than one quality. Thus for example glossed prints can be produced by a glossing class of fuser member. A quality of gloss can include "low" gloss (including matte), "medium" gloss, or "high" gloss. "Medium" gloss is preferably a standard gloss, i.e., where the toner gloss is approximately matched to the gloss of a (medium gloss) paper typically used for output prints. Furthermore, a quality of gloss, e.g., of an output print, can be quantitatively defined by a specific range of gloss numbers, e.g., by a range of $G_{60}$ gloss numbers. Other classes of fuser member include for example texturing fuser members and patterning fuser members. The corresponding surface finishes of texture and pattern can also have various qualities, e.g., specific textures or patterns of fused toner images, including embossment. In general, a validation number is determinable according to the invention for any kind of surface finish associated with a fuser member of any class or type. (Herein, the terms "class" and "type" are used interchangeably in reference to a fuser member).

According to the invention, "validating" or "validation of" a fuser member means confirming that a fuser member is included in a particular class of fuser member (e.g., for producing a certain quality of surface finish) and/or verifying that a heating behavior is within specification for that particular class of fuser member.

A fuser member for use in the subject invention includes any heated member which directly contacts and thereby fuses, preferably under pressure, the unfused toner image to the receiver member in the fusing station. Preferably, a fuser member for validation according to the invention is so validated after installation in the fusing station and prior to use therein. Any installed fuser member for validation is engaged under pressure with a rotatable member so as to form a fusing nip for purpose of fusing and thereby providing a surface finish to a fused toner image. Preferably the fuser member is a fuser roller which is readily exchangeable for another fuser roller, e.g., of a different class, or of the same class. Alternatively, the fuser member can be a just-installed rotatable exchangeable closed-loop belt entrained around a heatable roller with the belt indirectly heated by contact thereto, and which belt is captured by a nip formed between the heatable roller and a pressure roller. A heating behavior of such a belt can for example be obtained by using a temperature probe, preferably located close to the nip, so as to measure surface temperature of the belt as the heatable roller supporting the belt is being heated to an elevated temperature, preferably from ambient temperature.

A fuser member exchangeably installed in the fusing station can at a future time be interchanged or replaced with another fuser member of the same type, e.g., if the exchangeably installed fuser member is damaged or at the end of life. Typically, before a new job stream begins, an exchangeably installed fuser member is replaced by a different type fuser member that produces a different quality or type of surface finish.

FIG. 1A shows a generalized block diagram illustrating how a temperature-sensing device (TSD) can be used to generate, for purpose of validating a heating behavior of a fuser member, a TSD validation number for comparison with a reference range of TSD validation numbers. Apparatus 10 of FIG. 1A includes a fuser member 11 for validation according to the invention, a temperature-sensing device 12 for sensing temperature of the fuser member, a temperature-recording device (TRD) 13, a validation number generator (VNG) 14, and a comparator device (CD) 15. During a time interval during which fuser member 11 is being heated from an initial ambient temperature such that the temperature of the fuser member is steadily increasing, at least one TSD signal is generated in the temperature-sensing device 12 and sent to the temperature-recording device 13, in which TRD the at least one TSD signal is converted to at least one respective measured temperature. From the TRD at least one corresponding TRD output signal is generated and sent to the VNG 14. A TSD validation number is computed within VNG 14 from the at least one TRD output signal, which TSD validation number is sent to CD 15. Within CD 15, wherein is stored the reference range of TSD validation numbers, the TSD validation number is compared to the reference range of TSD validation numbers. If the TSD validation number is included in the reference range of TSD validation numbers, heating of the fuser member is continued. On the other hand, if the TSD validation number is not included in the reference range of TSD validation numbers, heating of the fuser member is terminated, and an error signal is generated by CD 15. Prior to heating of fuser member 11 for validation, the initial ambient temperature is a temperature of the fuser member at the location of installation, which ambient temperature can be for example room temperature.

Any suitable temperature-recording device 13 can be used. In certain applications, a human operator can subsume the functions of validation number generator 14 and comparator device 15, i.e., by using any suitable output signal from TRD 13 to compute the validation number so as to make comparison with a predetermined reference range of validation numbers.

Figure 1B:
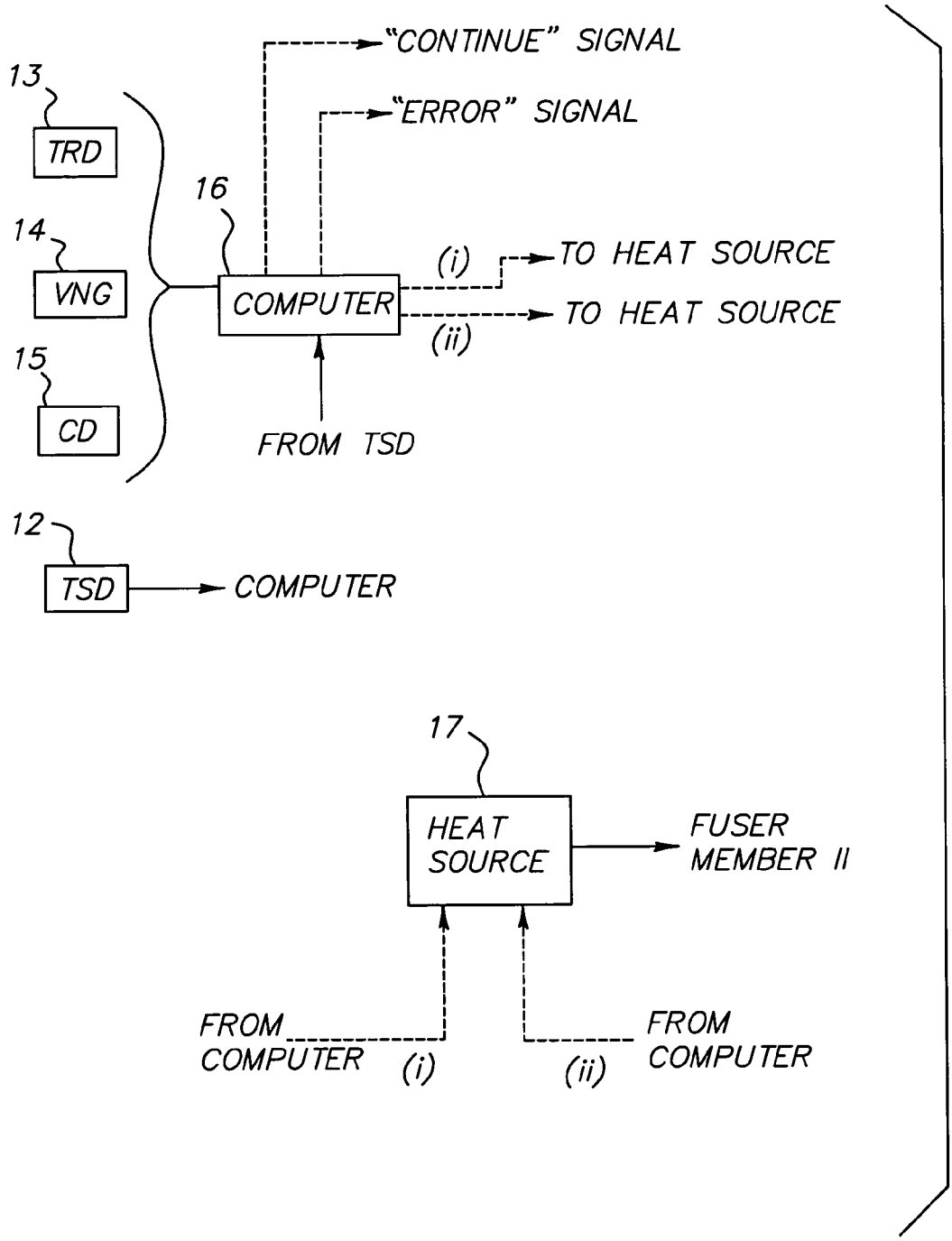
FIG. 1B shows, in reference to FIG. 1A, how a computer can be used to generate the validation number and to control a heat source for the fuser member.

A preferred embodiment of the apparatus of FIG. 1A is shown in the block diagram of FIG. 1B. In this preferred embodiment, temperature-recording device (TRD) 13, validation number generator (VNG) 14, and comparator device (CD) 15 are incorporated into a computer 16. The TSD signals from temperature-sensing device 12 are thus sent to computer 16. A heat source 17 provides heating of the fuser member 11 for validation thereof, which heat source is preferably controlled by computer 16. Thus heat source 17 can be switched on via signal (i) so as to initiate heating of fuser member 11 from ambient temperature, and can be switched off via signal (ii) so as to discontinue heating of the fuser member 11. In computer 16, the TSD validation number is computed for comparison to the reference range of TSD validation numbers, which reference range of TSD validation numbers is preferably stored in a look-up table in the computer. If the TSD validation number is included in the reference range of TSD validation numbers, heating of fuser member 11 is continued, and a "continue" signal is optionally displayed by computer 16. On the other hand, if the TSD validation number is not included in the reference range of TSD validation numbers, heating of fuser member 11 is terminated via a signal (ii) sent from computer 16 to heat source 17, and an "error" signal or a "discontinue heating" instruction can be displayed.

Alternatively, if the TSD signal sent to computer 16 can be used to generate a validation number by the VNG 14. The CD 15 then determines from the basic properties of the fuser roller, whether the roller is for, for example, high gloss or low gloss applications. The computer 16 can then generate a signal which assures that operating parameters are set for the type of installed fuser roller.

Figure 2A:
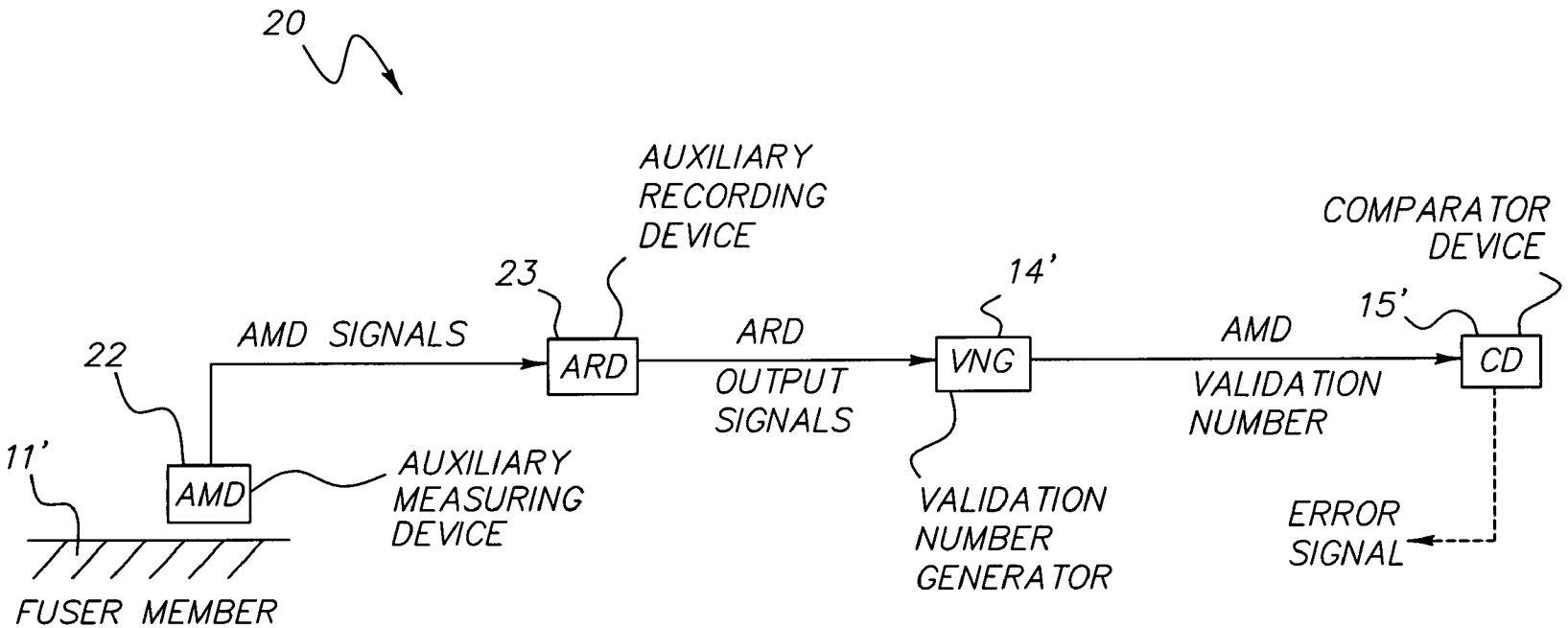
FIG. 2A is a generalized block diagram illustrating how an auxiliary measuring device can be used for measuring a temperature-dependent property of a fuser member so as to generate, for purpose of validating a heating behavior of the fuser member, a validation number for comparison with a reference range of validation numbers.

FIG. 2A is a generalized block diagram illustrating how an auxiliary measuring device can be used for measuring a temperature-dependent property of a fuser member so as to generate, for purpose of validating a heating behavior of the fuser member, a validation number for comparison with a reference range of validation numbers. In FIG. 2A, entities identified by numerals bearing a prime (') are entirely similar to entities identified by corresponding numerals in FIG. 1A. Apparatus 20 of FIG. 2A includes fuser member 11', auxiliary measuring device 22 for measuring a temperature-dependent property inherent to the fuser member, an auxiliary recording device (ARD) 23, validation number generator (VNG) 14', and comparator device (CD) 15'. During a time interval during which fuser member 11' is being heated from an initial ambient temperature such that the temperature of the fuser member is steadily increasing, at least one AMD signal is generated in the AMD 22 and sent to the ARD 23, in which ARD the at least one AMD signal is converted to magnitude of the temperature-dependent property. From the ARD at least one corresponding ARD output signal is generated and sent to the VNG 14'. An AMD validation number is computed within VNG 14' from the at least one ARD output signal, which AMD validation number is sent to CD 15'. Within CD 15', wherein is stored the reference range of AMD validation numbers, the AMD validation number is compared to the reference range of AMD validation numbers. If the AMD validation number is not included in the reference range of AMD validation numbers, an "error" signal is generated by comparator device 15'. Prior to heating of fuser member 11' for validation, the initial ambient temperature is a temperature of the fuser member at the location of installation, which ambient temperature can be for example room temperature.

Any auxiliary measuring device 22 and/or auxiliary recording device 23 that are suitable for measuring and recording magnitude of the temperature-dependent property can be used. AMD 22 can for example include a measurement probe for contacting the surface of fuser member 11'. In certain applications, a human operator can subsume the functions of validation number generator 14' and comparator device 15', i.e., by using any suitable output signal from ARD 23 to compute the validation number so as to make comparison with a predetermined reference range of validation numbers.

Figure 2B:
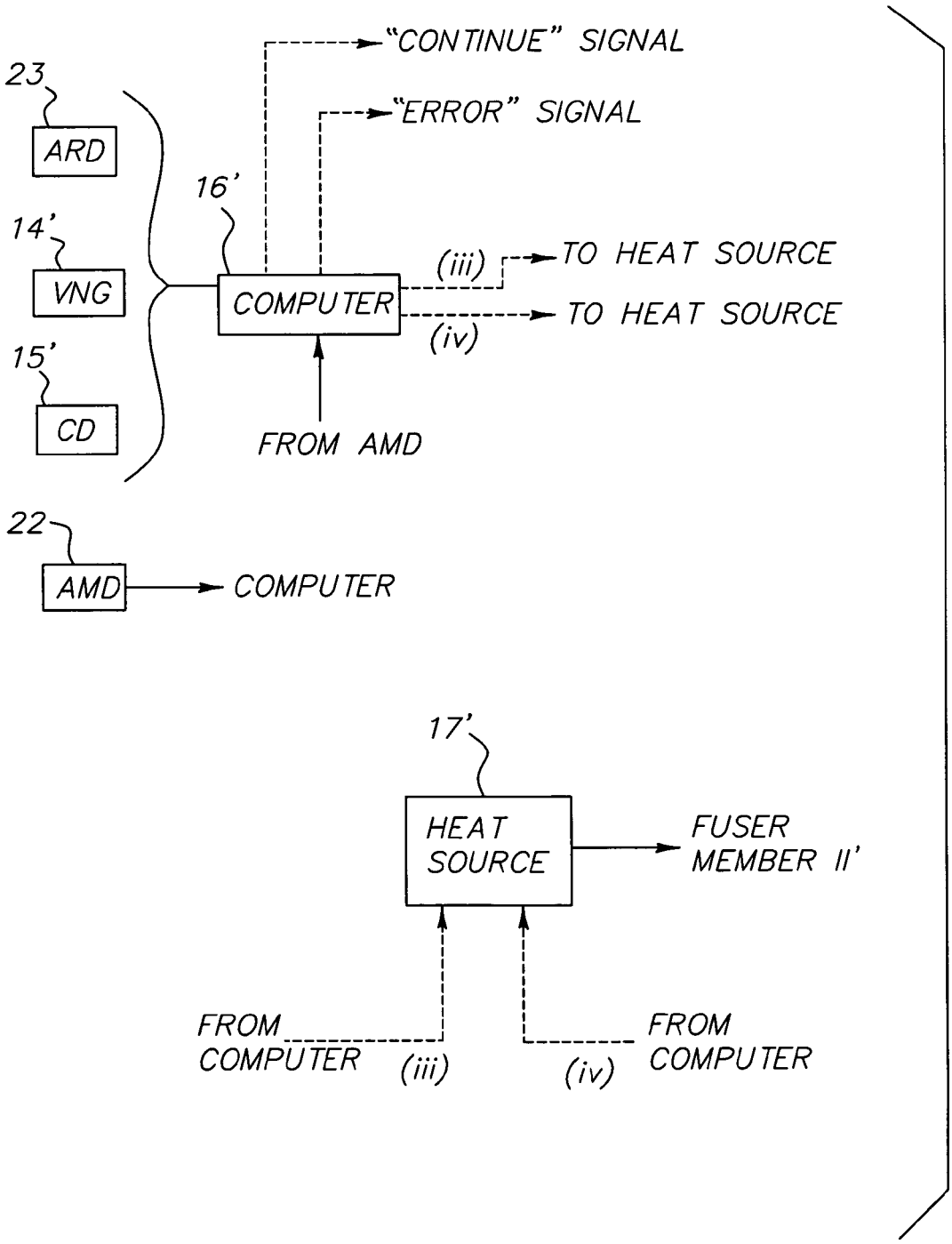
FIG. 2B shows, in reference to FIG. 2A, how a computer can be used to generate the validation number and to control a heat source for the fuser member.

A preferred embodiment of the apparatus of FIG. 2A is shown in the block diagram of FIG. 2B, in which entities identified by numerals bearing a prime (') are entirely similar to entities identified by corresponding numerals in FIGS. 1A, B and 2A. In this preferred embodiment, auxiliary recording device (ARD) 23, validation number generator (VNG) 14', and comparator device (CD) 15' are incorporated into computer 16'. The AMD signals from auxiliary measuring device 12 are thus sent to computer 16'. Heat source 17' is preferably controlled by computer 16'. Thus heat source 17' can be switched on via signal (iii) so as to initiate heating of fuser member 11' from ambient temperature. In computer 16', the AMD validation number is computed for comparison to the reference range of AMD validation numbers, which reference range of AMD validation numbers is preferably stored in a look-up table in the computer. If the AMD validation number is included in the reference range of AMD validation numbers, heating of the fuser member is continued, and a "continue" signal is optionally displayed by computer 16'. On the other hand, if the AMD validation number is not included in the reference range of AMD validation numbers, heating of fuser member 11' is terminated via a signal (iv) sent from computer 16' to heat source 17', and an "error" signal or a "discontinue heating" instruction can be displayed.

Figure 3:
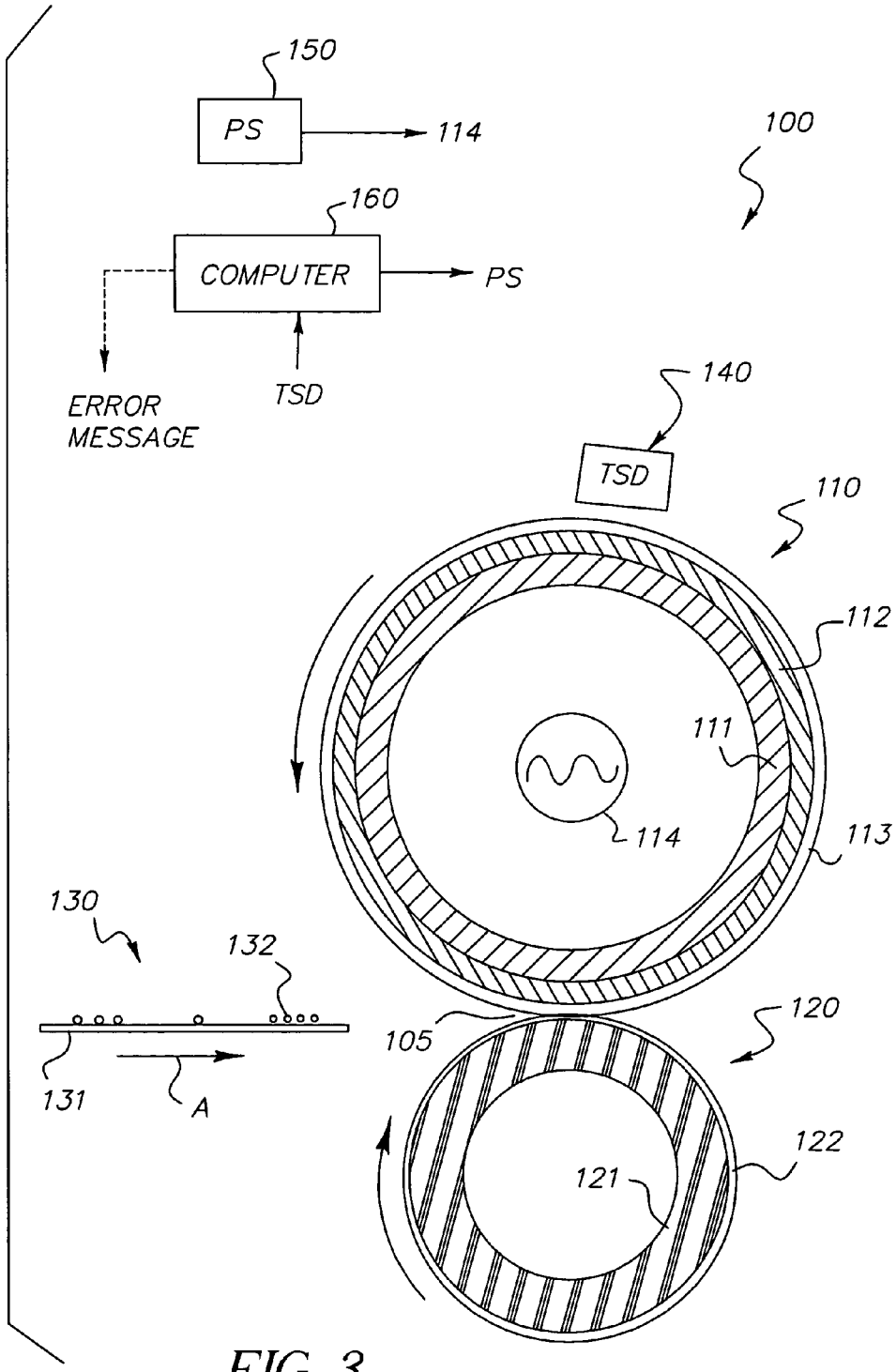
FIG. 3 schematically illustrates in side view an embodiment of a fusing station of the invention. The fusing station includes a fuser roller for imparting a surface finish to a fused toner image on a receiver member. During heating of the fuser roller, signals from the temperature-sensing device are sent to a computer wherein a validation number is computed and compared to a corresponding reference range of validation numbers so as to determine whether a magnitude of a property inherent to the roller is in a preselected range.

Fusing station 100 of FIG. 3 is exemplary of a preferred embodiment of apparatus of the invention wherein, during the heating of an operationally installed fuser member after start-up, a temperature-sensing device is used to measure at least one temperature of the fuser member as the temperature of the fuser member is increasing, i.e., for purpose of generating a validation number, e.g., a heating rate validation number.

Fusing station 100 is of well known type for use in an electrophotographic machine (electrophotographic machine not illustrated). Electrophotographic fusing station 100 includes a fuser member in the form of a resilient fuser roller 110 heated by any suitable heat source that is preferably energized by a source of electrical power, such as for example internal lamp 114 energized by a power supply (PS) 150. Fusing station 100 further preferably includes a relatively hard pressure roller 120 engaged with roller 110 so as to form a fusing nip 105. A toned member 130, including a receiver sheet 131 supporting an unfused toner image 132, is moved in direction of arrow, A, through nip 105 wherein the unfused toner image is fixed to the receiver sheet.

Fusing station 100 includes a temperature-sensing device (TSD) 140 for measuring temperature of a fuser roller 110 mounted in station 100. In practice of the present invention, TSD 140 is used to record temperature during at least the initial heating of the fuser roller following installation of the fuser roller in the fusing station. TSD 140 can be any temperature-sensing device from which signals can be sent to a recording mechanism, which recording mechanism is preferably a logic-and-control unit or computer, 160. Computer 160 can be used to control the electrical heating power, e.g., as provided to lamp 114. Preferably, a preselected constant electrical power is used to heat fuser roller 110, at least during the initial stage of heating. TSD 140 preferably measures surface temperature of roller 110, e.g., by a probe (e.g., a thermistor) located closely adjacent to, or in contact with, the surface of the roller. TSD 140 can alternatively include a temperature probe (located for example inside and contacting core member 111) for measuring temperature of the core member (temperature probe not illustrated).

Within the scope of the invention a same constant power can be provided throughout the entire heating process, thereby allowing roller 110 to approach an unconstrained final operating temperature. Such an operating temperature is inherent to roller 110 as installed in fusing station 100. In such a case, when the power level remains constant, the final operating temperature can at least in principle be used for validating the roller 110, e.g., if the final operating temperature lies in a reference range of operating temperatures. However, it is preferred that, in the final stage of heating, a feedforward or feedback technique be used in conjunction with computer 160 so as to reliably control the power to the heat source, thereby causing the temperature of fuser roller 110 to asymptotically approach a preselected operating temperature in a predetermined way.

Fuser roller 110 preferably includes a hollow cylindrical metal core member 111, preferably made of aluminum. A compliant or resilient cushion layer 112 that is preferably made of a polymeric material is preferably formed on core member 111, which cushion layer has a suitable thermal conductivity as is typically provided by incorporation of suitable fillers in known fashion. A thin protective release layer 113 is preferably coated on the cushion layer 112.

Pressure roller 120 includes a rigid core member 121, which core member is preferably coated with a protective layer 122. Roller 120 is preferably relatively noncompliant compared to roller 110, i.e., roller 120 is preferably relatively nondeformable in nip 105.

Prior to installation of fuser roller 110 in fusing station 100 and before validation of the fuser roller, the roller is presumptively of a certain type of fuser roller, which roller is expected to exhibit a corresponding heating behavior which can be validated according to the invention. For example, the temperature-versus-time heating profile for the installed roller 110 is presumptively such that a temperature reached at a certain time after the start of heating is in a reference range of temperature. If indeed the measured temperature at that certain time lies within that reference range, the roller 110 can be validated. Alternatively, the temperature of roller 110 may be measured at two times during initial heating of the roller, and if each of the corresponding temperatures lies in a corresponding reference range of temperature, the roller can be validated, and with more certainty. As another alternative, a heating rate can be calculated, e.g., by computer 160, which heating rate is derived from a slope of the temperature-versus-time heating profile and measured at a certain time after the start of heating, and if this heating rate lies within a reference range of heating rates, roller 110 can be validated. In practice of the invention, at least one value of any suitable metric (temperature, heating rate, and so forth) derivable from the heating behavior of the roller as measured by temperature-sensing device 140 can be used for validating roller 110.

Thus a validation number for validating roller 110 can be extracted by computer 160 from signals sent from TSD 140, which signals can be converted in the computer to calibrated values of temperature (alternatively, the temperature signals from TSD 140 are calibrated signals). A reference range of validation numbers (e.g., corresponding to temperature, or heating rate) is preferably stored in a lookup table in computer 160. If a validation number extracted from these signals has a magnitude that is not included in the corresponding reference range of validation numbers in the lookup table, the heating power for roller 110 is shut off, preferably by computer 160, and preferably an error message is displayed. On the other hand, if fuser roller 110 is validated, heating is continued without interruption to operating temperature followed by usage of the roller in fusing station 100.

Alternatively, if the TSD signal sent to computer 160 can be used to generate a validation number by the VNG 140. The CD 150 then determines from the basic properties of the copier, whether the roller is for, for example, high gloss or low gloss applications. The computer 160 can then generate a signal which assures that operating parameters are set for the type of installed copier.

Figure 4:
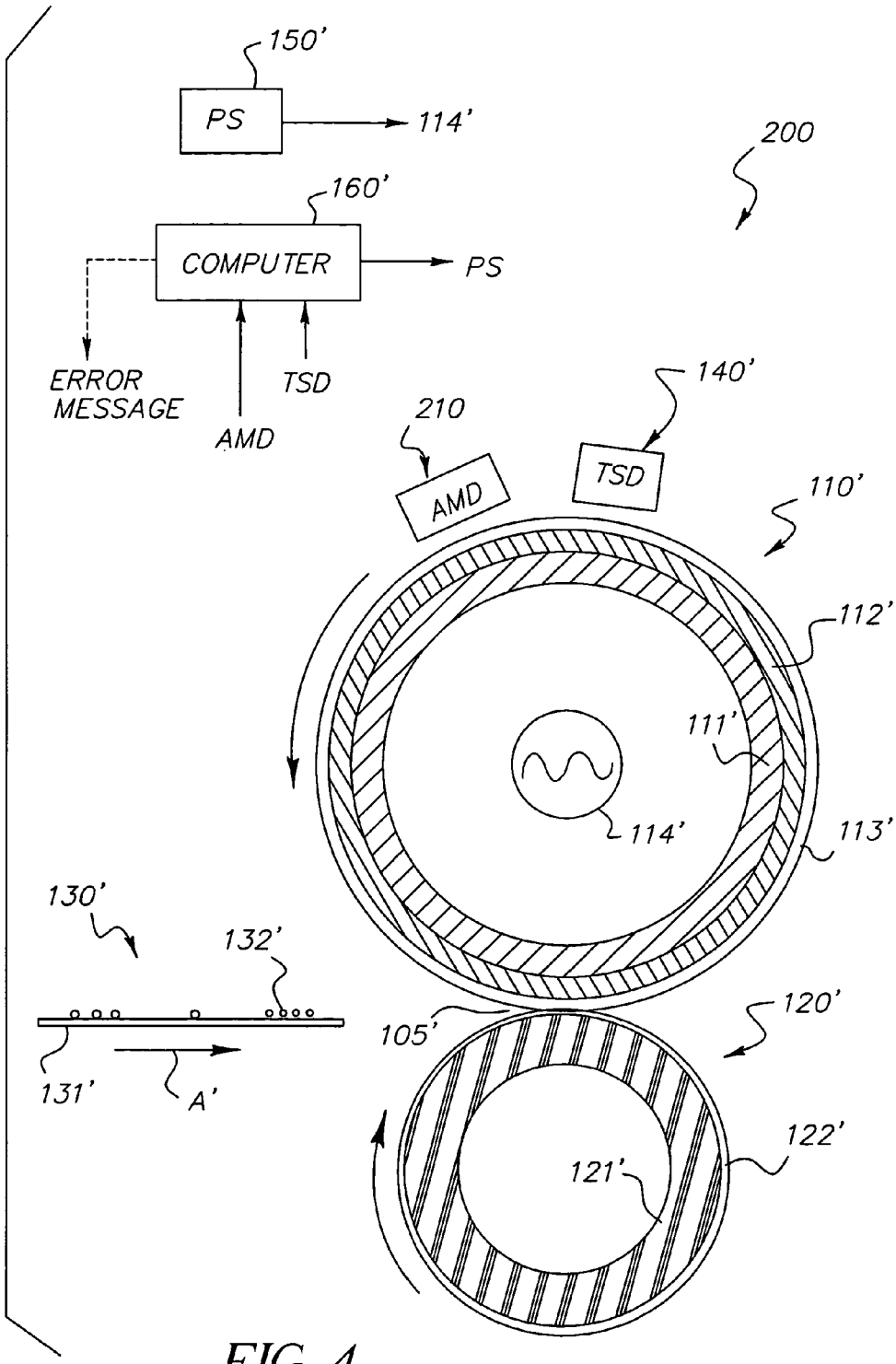
FIG. 4 schematically illustrates, in side view, a variation of the embodiment of FIG. 3, wherein the fusing station includes an auxiliary measuring device (AMD) for measuring magnitude of a temperature-dependent property of the roller. Signals from the AMD are used to calculate an AMD validation number for comparison to a corresponding AMD reference range so as to determine whether the magnitude of the temperature-dependent property is in a preselected range.

FIG. 4 schematically illustrates fusing station embodiment 200 which is a variant of embodiment 100 of FIG. 3. In embodiment 200, those entities identified by numerals bearing a prime (') are entirely similar to entities identified by corresponding numerals in FIG. 3. In addition to a temperature-sensing device TSD 140', the fusing station 200 includes an auxiliary measuring device (AMD) 210 for measuring a temperature-dependent property inherent to the installed fuser roller. The auxiliary measuring device 210 sends at least one signal to an auxiliary recording device, preferably computer 160', which at least one signal is proportional to a magnitude of the temperature-dependent property. The signals from the auxiliary measuring device 210 are used to calculate an AMD validation number, for comparison to a corresponding AMD reference range in a lookup table so as to determine whether a magnitude of the temperature-dependent property is in a preselected range. The signals from AMD 210 can also be utilized in conjunction with temperature signals from TSD 140', as described more fully below.

A temperature-dependent property of fuser roller 110' can for example include: (i) a color change of the roller caused by a change of temperature, which color change is preferably sensed by AMD 210 constructed as an optical detection device that can for example include a light pipe and/or a color filter with an optical detector; (ii) electrical conduction on the surface of or within the volume of roller 110', such that AMD 210 includes one or more probes to contact the surface of the roller so as to measure surface or volume electrical current during heating of the roller; (iii) heat radiated by roller 110' such that AMD 210 for example includes an infrared detector; (iv) an amount of heat flowing from the surface of roller 110' through a (contacting) probe such that AMD 210 for example includes the probe associated with a calorimetric device; and so forth.

A validation number can be obtained within the scope of the invention by use of the AMD 210 alone, e.g., by measuring the temperature-dependent property before the start of heating and/or at a predetermined time after heating is initiated. However, it is preferable to measure the temperature-dependent property by employing AMD 210 in conjunction with a corresponding measurement of temperature by using the temperature-sensing device TSD 140'. Thus two validation numbers can be obtained, e.g., at a certain time after heating is initiated, namely, a temperature validation number and an AMD validation number. The temperature validation number is compared with a reference range of temperatures, and the AMD validation number is compared with a reference range of AMD validation numbers. Preferably, roller 110' is validated only if the temperature validation number and the AMD validation number have magnitudes within the respective reference ranges.

In reference to FIG. 3, it will be understood that fusing station 100 is exemplary in the sense that fuser roller 110 can alternatively be heated in known fashion via any suitable external source of heat, e.g., by one or more heating rollers (not shown) contacting the fuser roller. In reference to FIG. 4, fusing station 200, which additionally includes an auxiliary measuring device such as AMD 210, is similarly exemplary. Moreover, in lieu of resilient fuser rollers 110, 110' and hard pressure rollers 120, 120', relatively hard fuser rollers and a resilient pressure rollers can be used for practice of the invention (relatively hard fuser rollers and resilient pressure rollers not illustrated).

Furthermore, it will be understood that a fuser member web (not illustrated) entrained around a heatable roller (not illustrated) can be used in lieu of fuser rollers 110, 110', in which case temperature-sensing devices similar to TSD 140, 140' can be used in proximity to nips 105, 105' so as to extract respective temperature validation numbers, e.g., from a temperature-versus-time behavior of the fuser member web as the heatable roller is heated to operating temperature. Similarly, when such a fuser member web is used, an auxiliary measuring device similar to AMD 210 can be employed so as to generate an AMD validation number.

Figure 5:
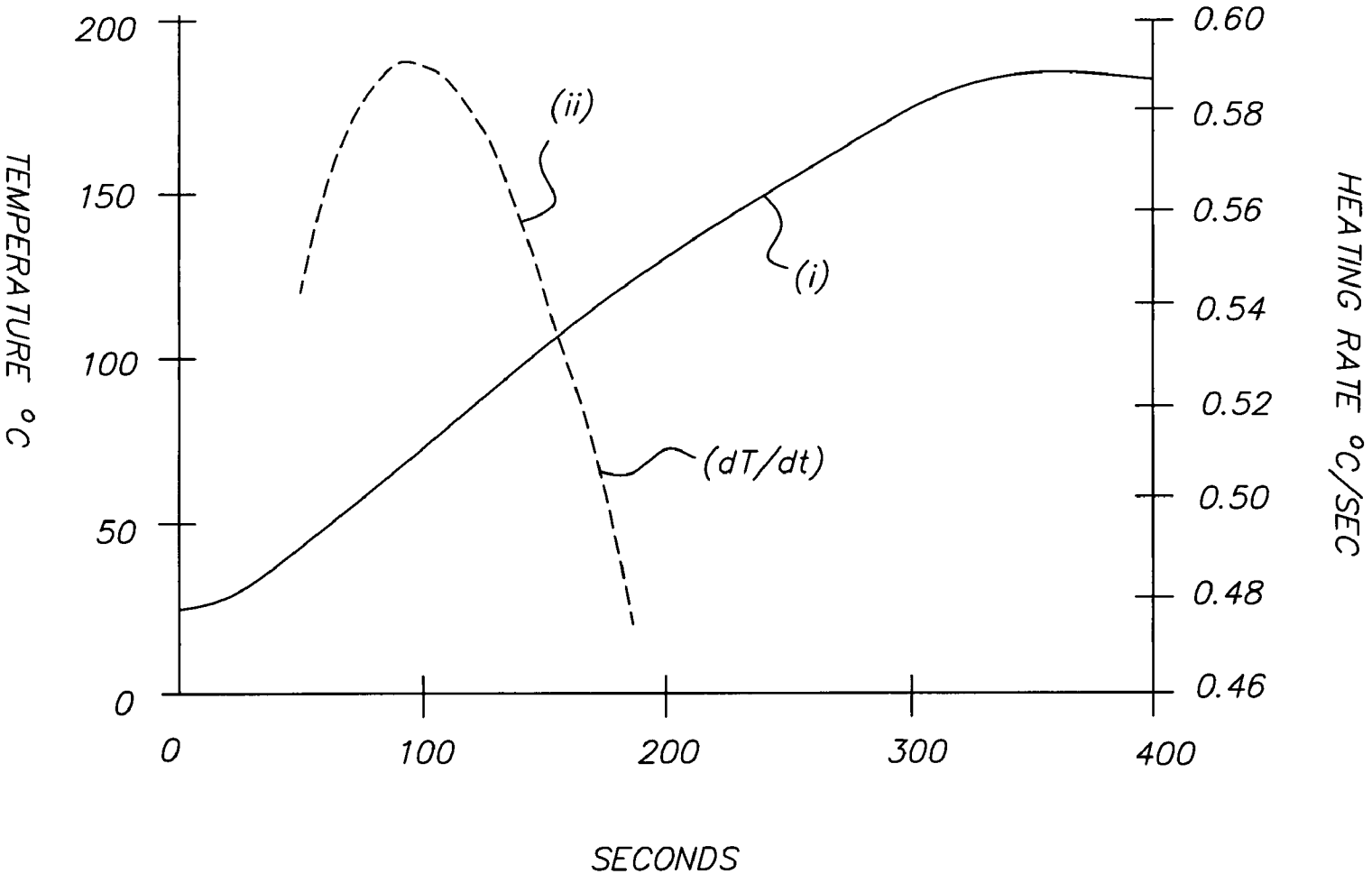
FIG. 5 shows a temperature-versus-time profile and a graph of heating rate derived therefrom, obtained from an exemplary fuser roller during heating from ambient temperature to operating temperature.

FIG. 5 illustrates heating behavior of an exemplary fuser roller during heating from ambient temperature to operating temperature. FIG. 5 includes a temperature-versus-time profile and a graph of heating rate derived therefrom. The fuser roller is similar to a type of compliant fuser roller employed in a fusing station of a NexPress 2100 printer manufactured by NexPress Solutions, of Rochester, N.Y. In FIG. 5, curve (i) shows temperature of the fuser roller (installed in a fusing station) as a function of heating time. In this example, a constant power input is provided to heat the roller during the initial stage of heating (below approximately 275 seconds of heating), whilst a computer is used to control the heating power supplied to the roller. For this exemplary heating, the temperature approached an operating temperature of about 185° C. after a heating time of about 350 seconds. Any suitable time can be chosen for validating the roller if a single temperature measurement is used. For example, at the particular time of about 150 seconds the roller temperature reached about 100° C. Thus, if a reference range of temperature included 100° C. corresponding to a heating time of 150 seconds, such a result could be used for validation of the roller. Curve (ii) of FIG. 5, derived from curve (i), shows a graph of heating rate (dT/dt) of the fuser roller as a function of heating time (heating rate plotted between about 50 seconds and 190 seconds). At the particular heating time of 150 seconds, for example, the heating rate was about 0.54° C./sec. Thus, if a reference range of heating rate included 0.54° C./sec for that heating time, this fact could permit validation of the roller. A more stringent validation can require that both of these validation numbers lie within the respective reference ranges. Moreover, it may be desirable that these validation numbers be generated for different heating times. Alternatively, from measurements of both temperature and dT/dt, a curve can be generated of dT/dt as a function of temperature (such as by using computer 160 of FIG. 3), thereby obtaining a validation number that is independent of the heating time, i.e., a validation number which is a heating rate as measured for a preselected roller temperature.

Figure 6:
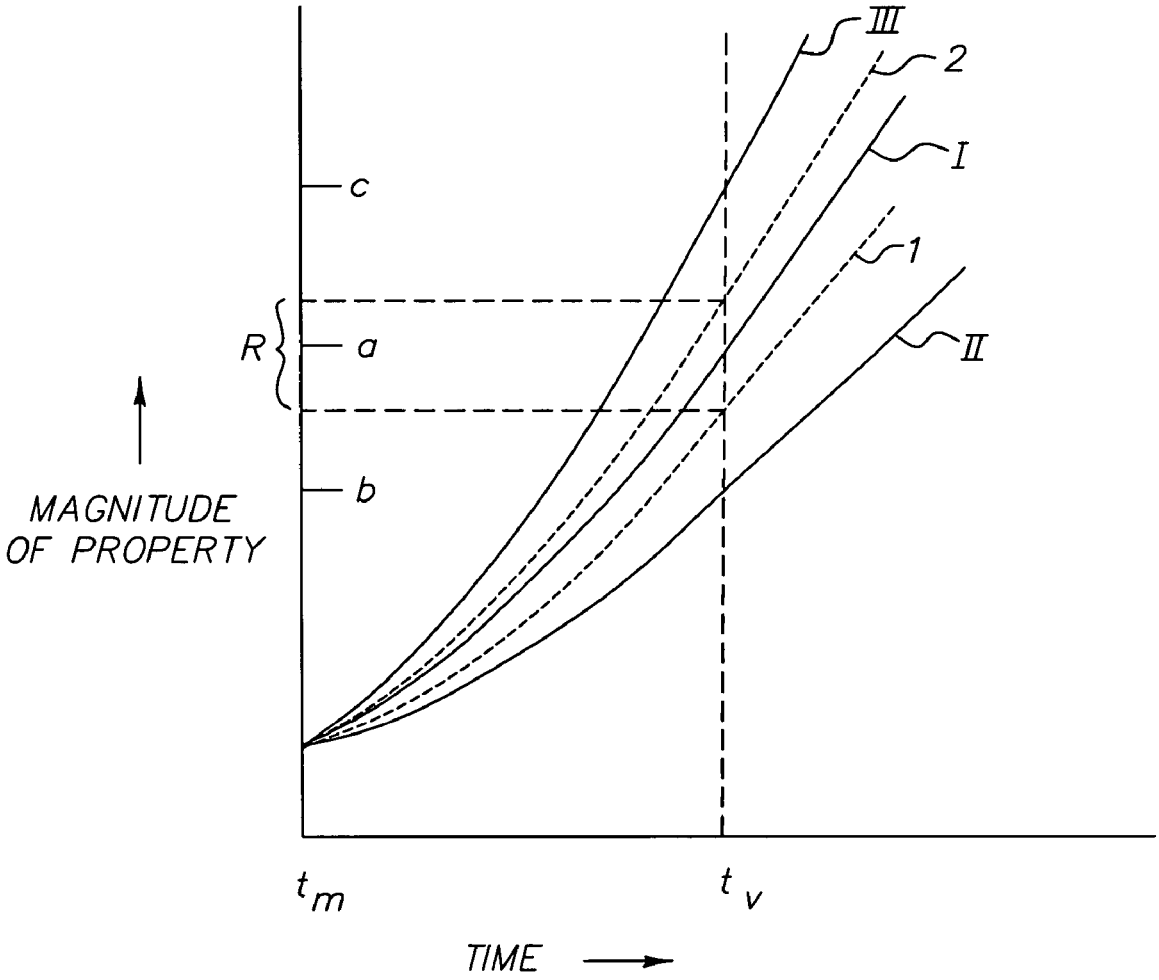
FIG. 6 shows schematic curves for which magnitude of a certain fuser-member property is plotted as a function of time during heating of the fuser member, the heating starting at a marker time, $t_M$. The dashed curves labeled "1" and "2" indicate validating limits of the behavior of the property. Curve "I" shows appropriate behavior for validation, while curves "II" and "III" show inappropriate behavior for validation. At a particular time, $t_V$, the limiting values obtained from curves "1" and "2" can define a reference range of validation numbers, R. The value, a, of curve "I" measured at the time, $t_V$, lies within the range R, thus validating the fuser member as a member of a certain type of fuser member, or alternatively validating that the heating behavior is within specification for that type. Either of values b, c, if measured at the time, $t_V$, would invalidate the fuser member.

FIG. 6 shows curves representing magnitude of an unspecified fuser-member property plotted schematically as a function of time during heating up of the fuser member, the heating starting at a marker time, $t_M$. The dashed curves labeled "1" and "2" indicate validating limits of the heating behavior. Curve "I", which lies between curves "1" and "2", shows appropriate behavior for validation, whilst curves "II" and "III" show inappropriate behavior for validation. For a certain particular time, $t_V$, the magnitudes obtained from the limiting curves "1" and "2" can define a reference range of validation numbers, R. The value, a, of curve "I" measured at the time, $t_V$, lies within the range R, thus validating a fuser member characterized by curve "I" as a member of a certain type of fuser member, or alternatively validating that the heating behavior is within specification for that type. Magnitudes b, c, if measured at time, $t_V$, would invalidate the respective fuser members characterized by curves "II" and "III".

The unspecified property having magnitude shown on the ordinate of FIG. 6 can be simply temperature of the fuser member, preferably surface temperature, such as for example measured for a fuser roller by TSD 140, 140' (FIGS. 3, 4). On the other hand, the property can be any suitable temperature-dependent property measurable, e.g., for a fuser roller, by AMD 210 (FIG. 4). Alternatively, a validation number can be obtained from a slope of curve "I" measured at a suitable time, say $t_V$, which slope would be compared with a reference range of slopes defined by the slopes of curves (i) and (ii) measured at time, $t_V$.

It is noted that although magnitude of a property typically increases with heating time, as shown in FIG. 6, for certain properties (e.g., electrical resistivity) the magnitude can decrease as a fusing member heats up. In such a case, the curves corresponding respectively to (i), (ii), I, II, and III will decrease in magnitude with increase of heating time.

Figure 7:
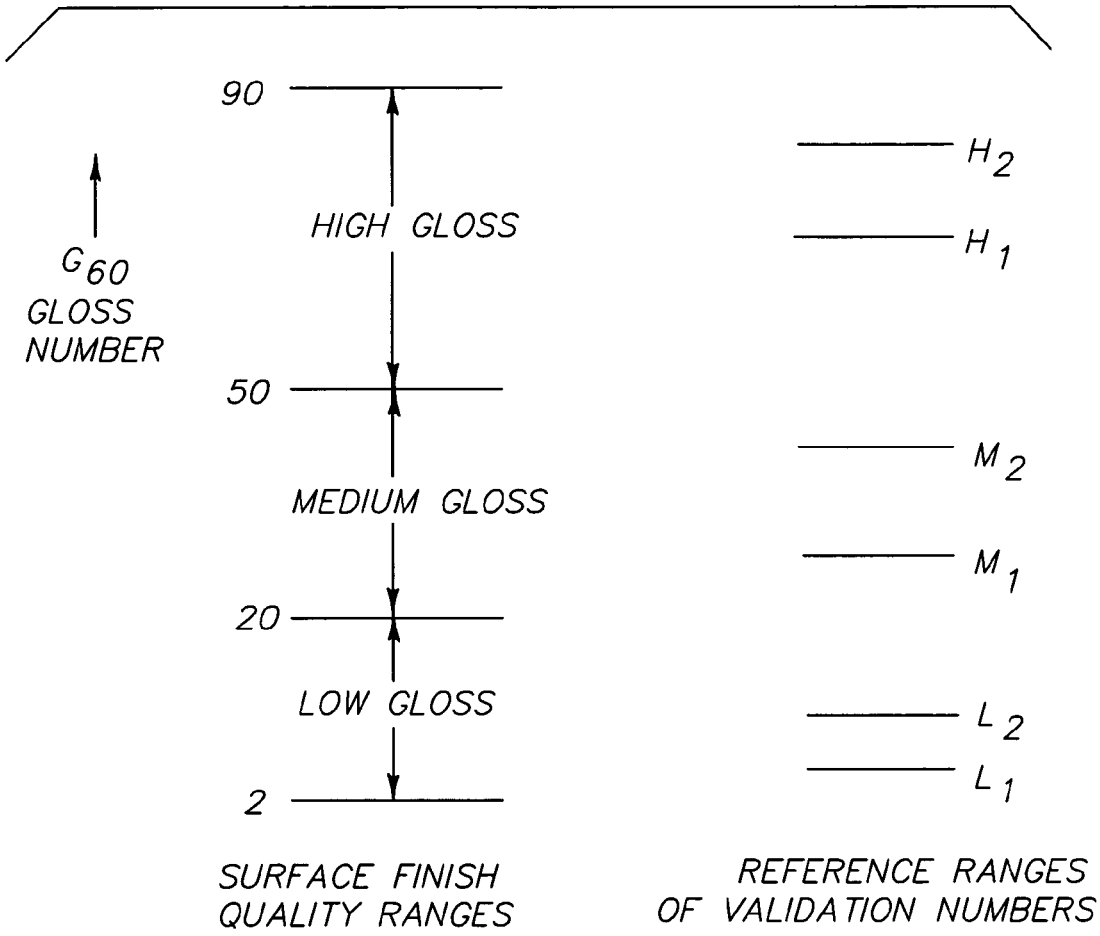
FIG. 7 is a schematic diagram indicating how three ranges of gloss number (surface finish quality) can relate to three respective reference ranges of gloss validation numbers for three corresponding fuser members.

FIG. 7 is a schematic diagram indicating how different ranges of a surface finish quality can relate to corresponding respective reference ranges of validation numbers for fuser members. Thus for example, as illustrated in FIG. 7, three different ranges of gloss can in certain applications be produced by three corresponding types of glossing fuser members, such that each type of glossing fuser member is validated using a different reference range of validation numbers. As illustrated in FIG. 7, a fuser member for "high" gloss surface finish ($G_{60}$ gloss number in a range of approximately 50–90) is validated if the respective validation number is within a reference range of validation numbers having a lower limit, $H_1$, and an upper limit, $H_2$. Similarly, a fuser member for "medium" gloss ($G_{60}$ between approximately 20–50) requires a validation number in a reference range defined by $M_1$ and $M_2$, whilst a fuser member for "low" gloss ($G_{60}$ between approximately 2–20) requires a validation number in a reference range defined by $L_1$ and $L_2$. Thus each type of glossing fuser member could for example have a different temperature-versus-time profile, e.g., because of differences in layer thicknesses and/or composition of the fuser members, or because of a different power level used for heating each type of glossing fuser member. However, it should not be inferred from FIG. 7 that the magnitudes of validation numbers in the reference range between $H_1$ and $H_2$ are greater than the magnitudes of validation numbers in the reference range between $M_1$ and $M_2$, or that the magnitudes of validation numbers in the reference range between $M_1$ and $M_2$ are greater than the magnitudes of validation numbers in the reference range between $L_1$ and $L_2$. In general, each reference range of validation numbers is defined by magnitudes appropriate for the usage of the respective fuser member. Moreover, the reference ranges of validation numbers can relate to validation numbers obtained from any measurement relating to a heating behavior of an installed fuser member, such as validation numbers obtained for a fuser roller from signals produced by TSD 140, or by AMD 210 and/or TSD 140' (FIGS. 3 and 4).

Notwithstanding the example of FIG. 7, in which each of the three gloss qualities are associated with different reference ranges of validation numbers, several qualities of a certain type of surface finish (e.g., gloss) can in certain applications be produced by fuser members that are validated with a same reference range of validation numbers. In such a case, the quality of the surface finish, e.g., of gloss, texture, or pattern, is typically determined by the superficial morphology of the fuser member, whilst the corresponding fuser members can have a common construction and composition. In such a case, verification primarily entails confirming that the particular heating behavior measured for such structurally similar fuser members occurs within predetermined specification limits.

In general, a validation number is defined as a TSD validation number if derived for any type of fuser member solely from measured temperature, e.g., from a temperature-versus-time profile, i.e., such that measured temperature is obtained using a temperature-sensing device (TSD) associated with the fuser member. As shown above in relation to FIG. 5, a TSD validation number can be a temperature or a heating rate (dT/dt).

Similarly, a validation number derived solely from a measurement of a temperature-dependent property of any type of fuser member can be defined as an AMD validation number, i.e., obtained using an auxiliary measuring device (AMD) associated with the fuser member.

Figure 8:
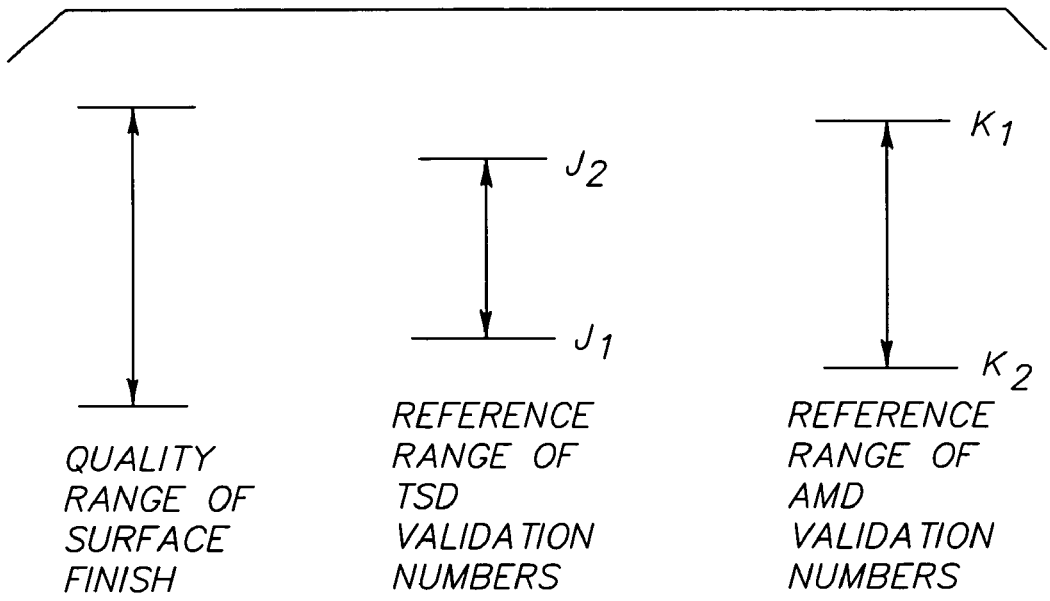
FIG. 8 is a schematic diagram showing how a fuser member for producing a surface finish with a range of quality can relate to two distinct reference ranges of validation numbers.

FIG. 8 is a schematic diagram showing how any type of fuser member for producing a surface finish (having for example a range of quality or a single level of quality) can relate to two distinct reference ranges of validation numbers, in particular to a reference range of TSD validation numbers and a reference range of AMD validation numbers. Thus a fuser member can be validated under the joint condition: that a TSD validation number lies within a reference range of TSD validation numbers defined by the limits $J_1$ and $J_2$, and that an AMD validation number lies within a reference range of AMD validation numbers defined by the limits $K_1$ and $K_2$.

The subject invention provides a method for validating a fuser member installed in an electrophotographic fusing station, which validating is for confirming that a heating behavior of the fuser member is within specification. The fuser member to be validated according to the method is presumptively of a class for imparting to a fused toner image a certain surface finish having a designated quality. In the method, at least one temperature of the fuser member is measured during a time interval during which temperature of the fuser member is increasing from an initial ambient temperature. The fusing station includes a temperature-sensing device (TSD) for measuring temperature of the fuser member, the fuser member for fusing a toner image on a receiver member moved through a fusing nip formed by the fuser member engaged under pressure with a rotatable member. A source of heat used for heating the fuser member is preferably energized by electrical power. The TSD is used in conjunction with a temperature-recording device (TRD), a validation number generator (VNG), and a comparator device (CD), the method including the steps of: (1) at a certain marker time, turning on the electrical power so as to energize the source of heat and cause, over the course of the time interval, heating up of the fuser member from the initial ambient temperature; (2) during the time interval generating, by means of the temperature-sensing device, TSD signals proportional to the at least one temperature of the fuser member; (3) sending the TSD signals to the temperature-recording device so as to generate therein TRD output signals corresponding to the TSD signals; (4) sending the TRD output signals to the VNG for generating therein a TSD validation number; (5) sending the TSD validation number to the CD; (6) comparing within the CD the TSD validation number to the reference range of TSD validation numbers; and (7) turning off the electrical power if the TSD validation number has a magnitude not included in the reference range of TSD validation numbers. Preferably, an additional step is carried out wherein an error message, created from an error signal generated by the computer, is displayed if the TSD validation number has a magnitude not included in the reference range of TSD validation numbers. It is preferred that the fuser member of the method is a fuser roller, and that the heating behavior is a heating rate of the fuser roller. It is furthermore preferred that the temperature-recording device, the validation number generator, and the comparator device are included in a computer, and that the TSD reference range of validation numbers is stored in a lookup table in the computer. Preferably, during the time interval, the electrical power is set by the computer to a predetermined constant power level.

In an alternate method for validating such a fuser member installed in a similar fusing station, the electrophotographic fusing station includes, in addition to a temperature-sensing device (TSD) for sensing temperature of the fuser member in a time interval during which temperature of the fuser member is increasing from an initial ambient temperature, the fuser member has mounted adjacent thereto an auxiliary measuring device (AMD) for producing, during the time interval, at least one AMD signal proportional to magnitude of a temperature-dependent property inherent to the fuser member. The at least one AMD signal is for generating an AMD validation number for comparison with a reference range of AMD validation numbers. The AMD is for use in conjunction with an auxiliary recording device (ARD), a validation number generator (VNG), and a CD wherein is stored the reference range of AMD validation numbers. In common with the above-described method, the alternate method is for confirming that a heating behavior which relates to the temperature-dependent property used for validating the fuser member is within specification. The alternate method includes the steps of: (1) at a certain marker time causing, over the course of the time interval, heating up of the fuser member from the initial ambient temperature; (2) during the time interval generating, by means of the auxiliary recording device, the at least one AMD signal; (3) sending the at least one AMD signal to the auxiliary recording device so as to generate therein at least one ARD output signal corresponding in one-to-one fashion to the at least one AMD signal; (4) sending the at least one ARD output signal to the VNG for generating therein an AMD validation number; (5) sending the AMD validation number to the CD; (6) comparing within the CD the AMD validation number to the reference range of AMD validation numbers; and (7) stopping the heating of the fuser member if the AMD validation number has a magnitude not included in the reference range of AMD validation numbers. Preferably, an additional step is carried out wherein an error message, created from an error signal generated by the computer, is displayed if the AMD validation number has a magnitude not included in the reference range of AMD validation numbers. It is preferred that the fuser member of the method is a fuser roller, and that the temperature-dependent property is an electrical current in the fuser roller, which electrical current is measured by the auxiliary measuring device so as to produce the at least one AMD signal relating to the heating behavior in which the current changes (increases) with heating. It is furthermore preferred that the auxiliary recording device, the validation number generator, and the comparator device are included in a computer, and that the AMD reference range of validation numbers is stored in a lookup table in the computer. Preferably, during the time interval, the electrical power is set by the computer to a predetermined constant power level.

In an extension of the alternate method described above, in which a computer is preferably used for processing signals generated by the auxiliary measuring device (AMD), at least one temperature of the fuser member is also measured via the temperature-sensing device (TSD) within the time interval. The extension of the alternate method includes the additional steps of: (8) substantially in coincidence with generating the AMD signals during the time interval, generating TSD signals in the temperature-sensing device, the TSD signals proportional to the at least one temperature of the fuser member; (9) sending the at least one TSD signal to the computer for generating therein a TSD validation number; (10) comparing the TSD validation number to a reference range of TSD validation numbers stored in a lookup table in the computer; and (11) stopping heating of the fuser member if the TSD validation number has a magnitude not included in the reference range of TSD validation numbers. Preferably, if the TSD validation number has a magnitude not included in the reference range of TSD validation numbers, another step is carried out wherein an error message, created from an error signal generated by the computer, is displayed. It is preferred that the fuser member of this extended alternative method is a fuser roller, and that the heating behavior is a heating rate of the fuser roller. Preferably, during the time interval, the electrical power is set by the computer to a predetermined constant power level.

The invention has been described in detail with particular reference to certain preferred embodiments thereof, but it will be understood that variations and modifications can be effected within the spirit and scope of the invention.

What is claimed:

1. Method for validating an exchangeable electrostatographic fusing station heatable fuser member for imparting a preselected surface finish to a fused toner image on a receiver member, for confirming that a heating behavior of said fuser member is within specification for said heating behavior, said method including the steps:

at a preselected time, heating up of a fuser member;

during said heating time, generating signals proportional to the heating behavior of such fuser member;

based on said fuser member temperature signal, generating a validation number;

comparing said validation number to a reference range of validation numbers; and generating a signal if said validation number has a magnitude not included in said reference range of validation numbers such that the generating signal is used for resetting fuser station set points.

2. Fuser member validating method of claim 1, wherein said generated signal is used as an error signal for an error message.

3. Fuser member validating method of claim 1, wherein the heating behavior is at least one temperature of such fuser roller.

4. Fuser member validating method of claim 1, wherein the heating behavior is a heating rate of such fuser roller.

5. Fuser member validating method of claim 1, wherein the heating behavior is a heating rate or temperature of such fuser roller, and an auxiliary heating behavior selected from the group consisting of color change, electrical conductance, reflectance, and heat flow rate of the fuser member.

6. Apparatus for validating an exchangeable electrostatographic fusing station heatable fuser member so as to validate that said fuser member belongs to a certain class of fuser members for imparting, to a fused toner image, a surface finish of designated quality, said fuser member validating apparatus comprising:

a source of heat for heating said fuser member;

a power supply for energizing said source of heat;

means for activating said power supply to energize said source of heat, thereby causing, over the course of a time interval, increasing of said temperature of said fuser member from an ambient temperature;

a temperature-sensing device for sensing at least one value of said temperature of said fuser member during a time interval in which said temperature of said fuser member is increasing, said temperature-sensing device generating signals corresponding to said at least one value of said temperature;

a validation number generator wherein in response to said signals from said temperature-sensing device, a validation number is generated;

a comparator wherein said generated validation number is compared with values included in a reference range of validation numbers, said reference range corresponding to said certain class of fuser member; and means for generating a signal if said validation number is not included in said reference range of validation numbers.

7. Apparatus of claim 6, wherein:

said fuser member comprises a fuser roller, said fuser roller specified to impart to said fused toner image a surface finish which is a gloss, said designated quality being one of low gloss, medium gloss, and high gloss.

8. Apparatus of claim 6, wherein said signal generated by said signal generating means is used for turning off heating of such fuser member.

9. Apparatus of claim 6, wherein said signal generated by said signal generating means is used for resetting fuser station setpoints.

10. Fuser member validating method of claim 6, wherein said generated signal is used as an error signal for an error message.

11. Apparatus of claim 6, including a computer which incorporates said means for activating said power supply, said validation member generation, a look-up table for said reference range of validation numbers, said comparator and said means for deactivating said power supply.

12. Apparatus for validating an exchangeable electrostatographic fusing station heatable fuser member so as to validates that said fuser member belongs to a certain class of fuser members for imparting, to a fused toner image, a surface finish of designated quality, said fuser member validating apparatus comprising:

a source of heat for heating said fuser member;

a power supply for energizing said source of heat;

means for activating said power supply to energize said source of heat, thereby causing, over the course of a time interval, increasing of said temperature of said fuser member from an ambient temperature;

a temperature-sensing device for sensing temperature of said fuser member;

an auxiliary measuring device for measuring magnitude of a temperature-dependent property of said fuser member, said auxiliary measuring device generating signals corresponding to the magnitude of said temperature-dependent property of at least one magnitude of said temperature-dependent property being measured during a time interval in which said temperature of said fuser member is increasing;

a computer for processing said signals wherein, at least once during said time interval at times corresponding to said sensing said at least one value of said temperature, respective signals are sent to said computer, said computer further including a validation member generator wherein, in response to signals from at least said auxiliary measuring device, a validation number is generated, and a comparator wherein said validation number is compared with values included in a reference range of validation numbers, said reference range corresponding to said certain class of said fuser member; and means for generating a signal if said validation number is not included in said reference range of validation numbers.

13. Apparatus of claim 12, wherein said signal generated by said signal generating means is used for turning off heating of such fuser member.

14. Apparatus of claim 12, wherein said signal generated by said signal generating means is used for resetting fuser station setpoints.

15. Fuser member validating method of claim 12, wherein said generated signal is used as an error signal for an error message.

16. Apparatus of claim 12, wherein:

said fuser member comprises a fuser roller, said fuser roller specified to impart to said fused toner image a surface finish which is a gloss, said designated quality being one of low gloss, medium gloss, and high gloss; and wherein said reference range of validation numbers is stored in a lookup table in said computer.

17. Apparatus of claim 12, wherein said validation number generator generates said validation number in response to signals from said auxiliary measuring device and said temperature-sensing device.

* * * * *